US011754010B2

(12) United States Patent
Izumi

(10) Patent No.: US 11,754,010 B2
(45) Date of Patent: Sep. 12, 2023

(54) COMBUSTION APPARATUS THAT COMBUSTS FUEL

(71) Applicant: Save The Planet Co., Ltd., Osaka (JP)

(72) Inventor: Mitsuhiro Izumi, Osaka (JP)

(73) Assignee: SAVE THE PLANET CO., LTD., Osaka (JP)

( * ) Notice: Subject to any disclaimer, the term of this patent is extended or adjusted under 35 U.S.C. 154(b) by 0 days.

(21) Appl. No.: 17/632,409

(22) PCT Filed: Aug. 22, 2019

(86) PCT No.: PCT/JP2019/032909
§ 371 (c)(1),
(2) Date: Feb. 2, 2022

(87) PCT Pub. No.: WO2021/033323
PCT Pub. Date: Feb. 25, 2021

(65) Prior Publication Data
US 2022/0290625 A1 Sep. 15, 2022

(51) Int. Cl.
*F02D 41/14* (2006.01)
*F02D 35/02* (2006.01)
*F02D 41/00* (2006.01)

(52) U.S. Cl.
CPC ..... *F02D 41/1454* (2013.01); *F02D 35/021* (2013.01); *F02D 41/0027* (2013.01);
(Continued)

(58) Field of Classification Search
CPC ..... F02D 41/1454; F02D 35/021; F02D 41/0027; F02D 41/1441; F02D 41/1461;
(Continued)

(56) References Cited

U.S. PATENT DOCUMENTS

2002/0175156 A1* 11/2002 Hotta ..... F02P 19/028 123/145 A
2011/0259290 A1* 10/2011 Michikawauchi .. F02D 19/0692 123/1 A (Continued)

FOREIGN PATENT DOCUMENTS

JP 48-10636 A 2/1973
JP 63-189624 A 8/1988

(Continued)

OTHER PUBLICATIONS

Japanese Office Action for Japanese Application No. 2018-077360, dated Jun. 7, 2022.

(Continued)

*Primary Examiner* — Joseph J Dallo
(74) *Attorney, Agent, or Firm* — Birch, Stewart, Kolasch & Birch, LLP

(57) ABSTRACT

A fuel combustion apparatus 2 according to the present invention includes: a combustion cylinder 4; a fuel feed unit 6 that introduces a swirling flow of an air-fuel mixture into the combustion cylinder; an ignition unit 10 including an igniter 32 located in the combustion cylinder 4; an ion detection unit 12 including a detector 40 located in the combustion cylinder 4; and a control unit 14 that adjusts a mixing ratio of the fuel based on a detection result obtained by the ion detection unit 12. Preferably, the fuel is ammonia. Preferably, the detector 40 is located in the vicinity of the igniter 32.

18 Claims, 6 Drawing Sheets

(52) U.S. Cl.
CPC ..... *F02D 41/1441* (2013.01); *F02D 41/1461* (2013.01); *F02D 2250/36* (2013.01)

(58) Field of Classification Search
CPC .. F02D 2250/36; F02D 19/0644; F02P 21/00; F23N 5/00; F23N 5/12
See application file for complete search history.

(56) References Cited

U.S. PATENT DOCUMENTS

| | | | | |
|---|---|---|---|---|
| 2011/0265463 | A1 | 11/2011 | Kojima et al. | |
| 2016/0201636 | A1* | 7/2016 | Inada | F02P 3/09 123/625 |
| 2017/0314500 | A1* | 11/2017 | Ogata | F02D 13/0261 |
| 2019/0003366 | A1* | 1/2019 | Kimura | F02D 41/1454 |

FOREIGN PATENT DOCUMENTS

| | | | | | |
|---|---|---|---|---|---|
| JP | 2010-159705 | A | | 7/2010 | |
| JP | 2011-210514 | A | | 10/2011 | |
| JP | 2016-130619 | A | | 7/2016 | |
| JP | 2017-166381 | A | | 9/2017 | |
| JP | 2018-155412 | A | | 10/2018 | |
| JP | 2019-184179 | A | | 10/2019 | |
| JP | 2019184179 | A | * | 10/2019 | |
| WO | WO-9930811 | A1 | * | 6/1999 | B01D 53/565 |
| WO | WO-2004106715 | A1 | * | 12/2004 | F01L 1/18 |
| WO | WO 2011/136151 | A1 | | 11/2011 | |
| WO | WO-2014180927 | A1 | * | 11/2014 | F02D 35/021 |
| WO | WO-2016072157 | A1 | * | 5/2016 | F02D 13/0261 |
| WO | WO-2018159693 | A1 | * | 9/2018 | C02F 1/28 |
| WO | WO-2021024511 | A | * | 2/2021 | F23K 5/00 |
| WO | WO-2021033323 | A1 | * | 2/2021 | F02D 35/021 |

OTHER PUBLICATIONS

International Search Report (PCT/ISA/210) issued in PCT/JP2019/032909, dated Nov. 12, 2019.
Written Opinion of the International Searching Authority (PCT/ISA/237) issued in PCT/JP2019/032909, dated Nov. 12, 2019.

* cited by examiner

COMBUSTION APPARATUS THAT COMBUSTS FUEL

TECHNICAL FIELD

The present invention relates to combustion apparatuses that combust fuels. In particular, the present invention relates to a combustion apparatus that combusts a flame-retardant fuel such as ammonia.

BACKGROUND ART

There is a growing demand for reduction of carbon dioxide emissions. Against this background, ammonia is attracting attention as a promising alternative to carbon-based fuels. Ammonia is free of carbon, and thus combustion of ammonia does not produce carbon dioxide. Ammonia has already been used widely as a fertilizer, is inexpensive, and can be stably supplied. Ammonia is liquefiable at a pressure similar to that for liquefaction of LPG, and can be stored in liquid form at room temperature. Ammonia has many benefits as an alternative to carbon-based fuels.

However, ammonia is flame-retardant. While the ignition energy for ignition of carbon-based fuels is from about 80 to 120 mJ, ignition of ammonia requires an ignition energy of about 400 to 600 mJ. Additionally, the laminar burning velocity of ammonia is about 7 times lower than the laminar burning velocity of carbon-based fuels. Japanese Laid-Open Patent Application Publication No. 2010-159705 reports an investigation of an internal combustion engine fueled by ammonia which is flame-retardant.

CITATION LIST

Patent Literature

PTL 1: Japanese Laid-Open Patent Application Publication No. 2010-159705

SUMMARY OF INVENTION

Technical Problem

However, more problems remain unsolved in combustion of flame-retardant fuels such as ammonia fuel than in combustion of carbon-based fuels which are currently widespread. Examples of the problems include the difficulty of initial ignition and the difficulty of stable combustion. In particular, it is crucial to enable the maintenance of stable combustion in order to put a combustion apparatus using a flame-retardant fuel into practical applications in various fields.

An object of the present invention is to provide a combustion apparatus capable of stably maintaining combustion of flame-retardant fuels.

Solution to Problem

A combustion apparatus that combusts a fuel according to the present invention includes: a combustion cylinder; a fuel feed unit that introduces a swirling flow of an air-fuel mixture into the combustion cylinder; an ignition unit including an igniter located in the combustion cylinder; an ion detection unit including a detector located in the combustion cylinder; and a control unit that adjusts a mixing ratio of the air-fuel mixture based on a detection result obtained by the ion detection unit.

Preferably, the fuel is ammonia.

Preferably, the detector is located in the vicinity of the igniter. The detector may be the same entity as the igniter.

Preferably, the igniter includes a discharge electrode and a first grounded electrode, the detector includes an application electrode and a second grounded electrode, and the first and second grounded electrodes are the same electrode.

Preferably, the igniter is located in an area which is inside the combustion cylinder and in which the air-fuel mixture is retained.

Preferably, the combustion cylinder includes a tubular barrel and a bottom cover mounted on a bottom of the barrel, the bottom cover includes a feed inlet through which the air-fuel mixture is introduced into the barrel, and the igniter and the detector are located on the bottom cover.

Preferably, the detectors are located on each of the bottom cover and the barrel.

Preferably, the feed inlet is ring-shaped, and the igniter and the detector are located on an area of the bottom cover, the area being surrounded by the feed inlet.

The feed inlet may be circular, and the igniter and the detector on the bottom cover may be arranged around the feed inlet.

The igniter is located in an area which is inside the combustion cylinder and in which the air-fuel mixture is not retained, or the igniter is one of a plurality of igniters located in the combustion cylinder, and at least one of the igniters may be located in the area in which the air-fuel mixture is not retained.

Preferably, the igniters are located on the bottom cover and the barrel.

A fuel combustion method according to the present invention includes a combustion step of combusting a fuel continuously. The combustion step includes: introducing a swirling flow of an air-fuel mixture containing the fuel into a combustion cylinder; igniting the introduced air-fuel mixture; detecting ions generated by the combustion of the fuel; and adjusting a mixing ratio of the air-fuel mixture based on an ion detection result.

Preferably, the combustion method further includes the step of measuring a correlation between a parameter indicative of a combustion state of the fuel and the ion detection result and defining a reference range for the ion detection result before the combustion step. The mixing ratio of the air-fuel mixture is adjusted to allow the ion detection result to fall within the reference range.

Preferably, the parameter indicative of the combustion state of the fuel includes the amount of oxides emitted during the combustion.

Advantageous Effects of Invention

The fuel combustion apparatus according to the present invention includes the ionic current detection unit located in the combustion cylinder and thus can identify the combustion state of the air-fuel mixture introduced into the combustion cylinder. Additionally, the apparatus includes the control unit that adjusts the air-fuel ratio of the air-fuel mixture and thus can achieve appropriate air-fuel ratio control based on the identified combustion state.

In the combustion apparatus, a swirling flow of the air-fuel mixture is introduced into the combustion cylinder. This leads to the combustion cylinder having an internal area in which the air-fuel mixture forms an eddy flow slower than the main swirling flow ("area in which the air-fuel mixture is retained"). In the case where the ignition unit and the ion detection unit are located in the retention area, the combustion apparatus can identify the state of the flame kernel since the ionic current reflects the combustion state in the area where effective energy supply is ensured. Additionally, the apparatus includes the control unit that adjusts the air-fuel ratio of the air-fuel mixture and thus can achieve air-fuel ratio control based on the state of the flame kernel.

In the case where the ignition unit and the ion detection unit are located in an area away from the retention area, the combustion apparatus can identify the level of stability of the combustion since the ionic current reflects the combustion state in the area where the air-fuel mixture flows at a relatively high velocity. Additionally, the apparatus includes the control unit that adjusts the air-fuel ratio of the air-fuel mixture and thus can achieve air-fuel ratio control conducive to stabilization of the combustion.

DESCRIPTION OF EMBODIMENTS

The following will describe in detail the present invention based on preferred embodiments with appropriate reference to the drawings.

Figure 1:
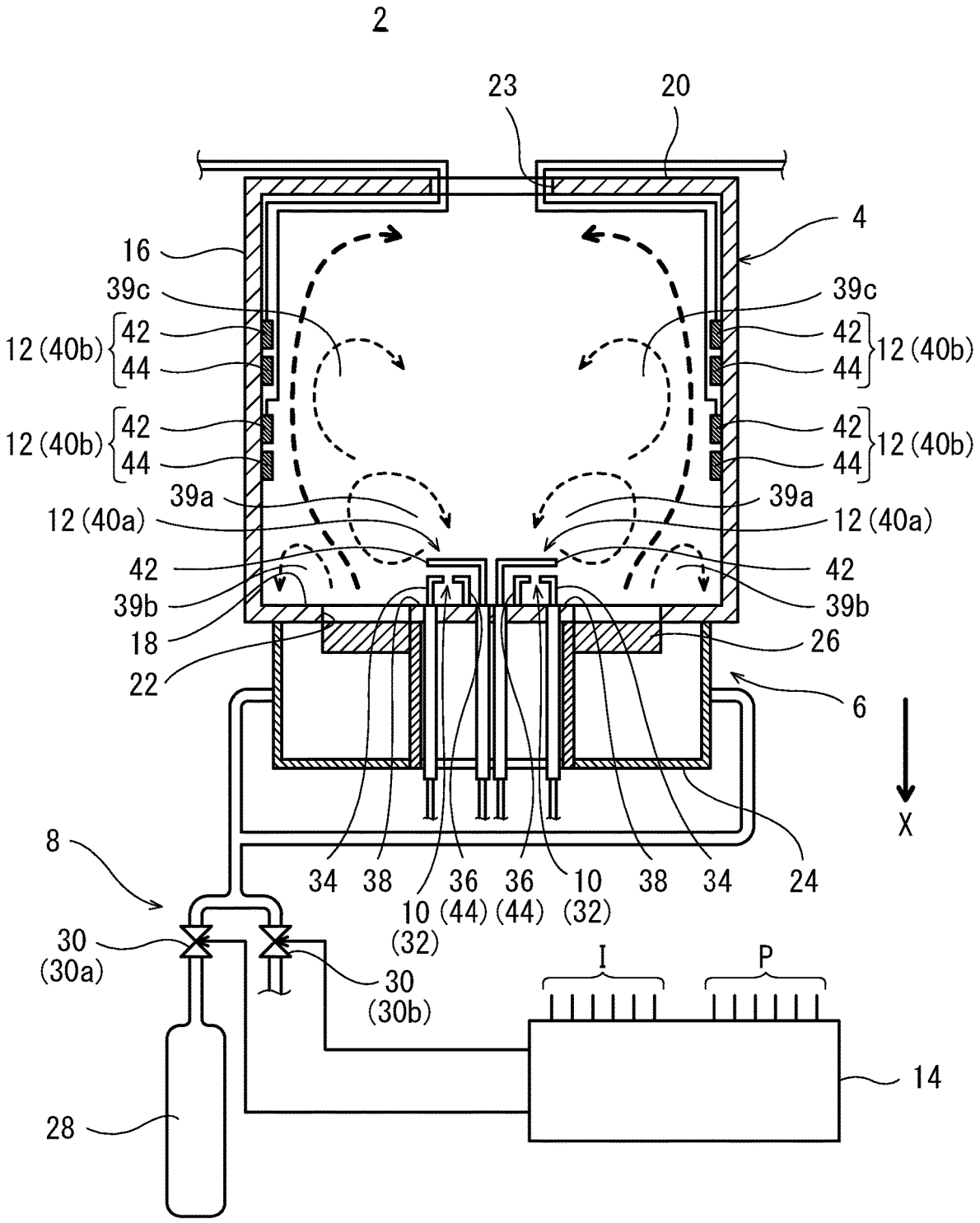
FIG. 1 is a conceptual diagram of a combustion apparatus according to one embodiment of the present invention.

FIG. 1 is a conceptual diagram of a fuel combustion apparatus 2 according to an embodiment of the present invention. In this figure, part of the apparatus 2 is shown in cross-section. The combustion apparatus 2 includes a combustion cylinder 4, a fuel feed unit 6, a fuel mixing unit 8, ignition units 10, ion detection units 12, and a control unit 14. In this specification, the direction indicated by the arrow X of FIG. 1 is the downward direction with respect to the combustion apparatus 2, and the opposite direction is the upward direction with respect to the combustion apparatus 2. The direction in which the fuel feed unit 6 is located is the downward direction.

Figure 2:
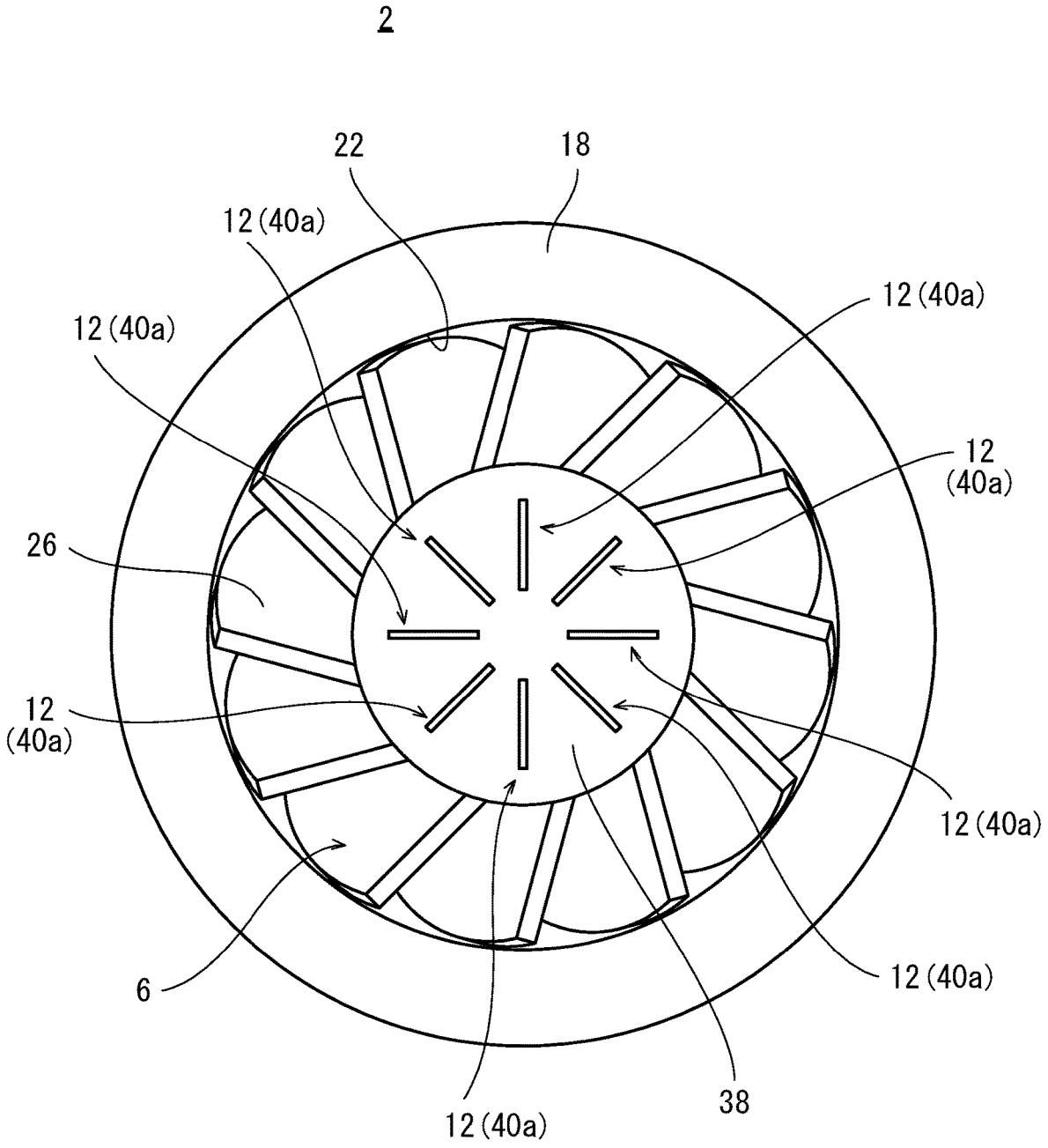
FIG. 2 is a top view of part of the combustion apparatus of FIG. 1.

The combustion cylinder 4 is tubular. In this embodiment, the combustion cylinder 4 is in the shape of a cylindrical tube. In FIG. 1, the combustion cylinder 4 is shown in cross-section. The combustion cylinder 4 includes a barrel 16, a bottom cover 18, and a top cover 20. The barrel 16 forms the circumferential surface of the combustion cylinder 4. The barrel 16 extends in the vertical direction. The bottom cover 18 is mounted on the bottom of the barrel 16. The bottom cover 18 includes a feed inlet 22. A gas mixture containing a fuel (air-fuel mixture) is introduced into the barrel 16 through the feed inlet 22. FIG. 2 shows the bottom cover 18 as viewed from above. In this embodiment, the feed inlet 22 is in the shape of a circular ring as shown in FIG. 2. The top cover 20 is mounted on the top of the barrel 16. An outlet 23 from which a flame spurts is located at the center of the top cover 20. In this embodiment, the material of the combustion cylinder 4 is heat-resistant glass.

As shown in FIG. 1, the fuel feed unit 6 is located beneath the bottom cover 18 of the combustion cylinder 4. The fuel feed unit 6 includes a housing 24 and a swirler 26. The housing 24 is ring-shaped when viewed from below. The housing 24 has a hollow interior. The swirler 26 is located in the interior of the housing 24. The swirler 26 is located beneath the feed inlet 22. In FIG. 2, the swirler 26 located beneath the feed inlet 22 is seen through the feed inlet 22. The swirler 26 includes a plurality of inclined vanes. The air-fuel mixture introduced into the housing 24 passes through the swirler 26, thus forming a gas flow (swirling flow) accompanied by eddies (swirls). The swirling flow of the air-fuel mixture is introduced into the combustion cylinder 4. The material of the swirler 26 is typically steel.

Although not shown, the fuel feed unit 6 may further include an actuator that rotates the swirler 26. A swirling flow of the air-fuel mixture may be introduced into the combustion cylinder 4 by rotation of the swirler 26.

The fuel mixing unit 8 includes a fuel tank 28 and valves 30. In this embodiment, the fuel mixing unit 8 includes a first valve 30*a* and a second valve 30*b*. The fuel tank 28 contains a flame-retardant fuel used as the main fuel of the combustion apparatus 2. In this embodiment, the fuel tank 28 contains liquefied ammonia. The liquefied ammonia is gasified, and the gaseous ammonia is delivered to the fuel feed unit 6. The first valve 30*a* is connected to the fuel tank 28. The first valve 30*a* regulates the amount of the fuel in the air-fuel mixture. The second valve 30*b* regulates the amount of air in the air-fuel mixture.

The fuel mixing unit 8 may further include a fuel tank containing an auxiliary fuel and a third valve connected to this fuel tank. In this case, the fuel mixing unit 8 mixes the two kinds of fuels with air. The auxiliary fuel is more combustible than the main fuel. That is, the ignition energy of the auxiliary fuel is lower than the ignition energy of the main fuel, and the laminar burning velocity of the auxiliary fuel is higher than the laminar burning velocity of the main fuel. Adding the highly combustible auxiliary fuel facilitates ignition of the air-fuel mixture. A typical example of the auxiliary fuel is methane. The combustion apparatus 2 may include three or more fuel tanks.

Figure 3:
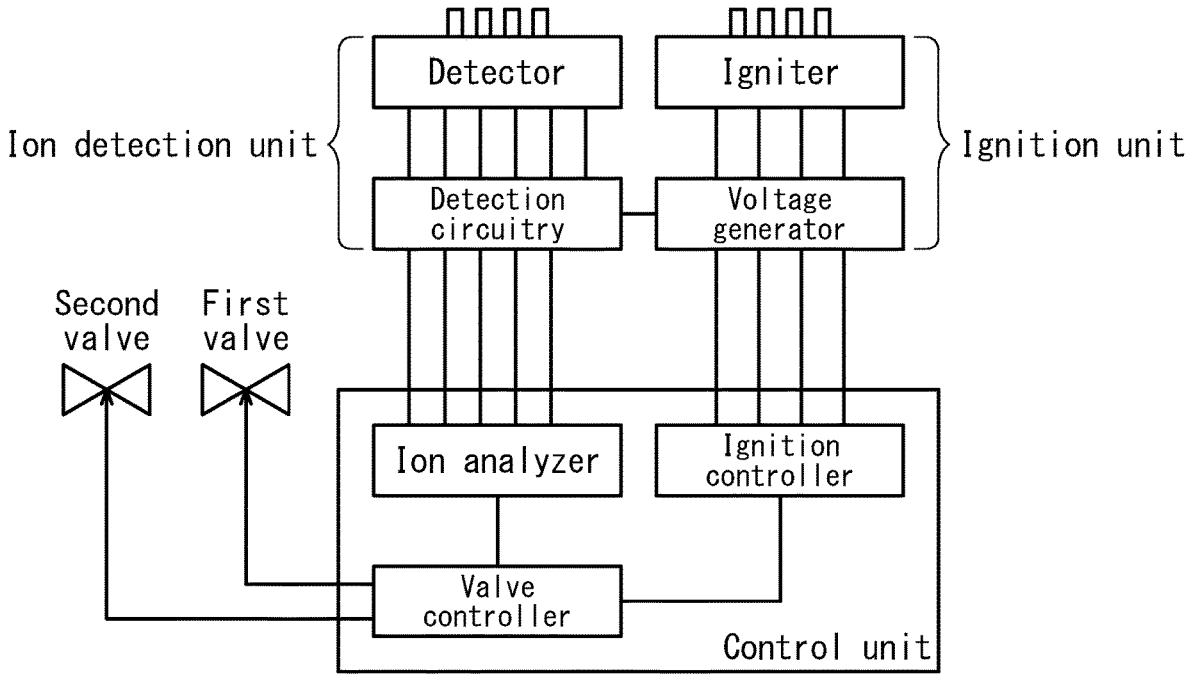
FIG. 3 is a connection diagram showing part of the combustion apparatus of FIG. 1.

FIG. 3 is a connection diagram showing the connection among the ignition unit 10, ion detection unit 12, and control unit 14.

The ignition units 10 ignite the air-fuel mixture. As shown in FIG. 3, each ignition unit 10 includes an igniter 32 and a voltage generator. Of these components of the ignition units 10, the igniters 32 are shown in FIG. 1. In FIG. 1, two of the igniters 32 are shown.

The igniter 32 is located in an "area in which the air-fuel mixture is retained." In FIG. 1, the swirling flow of the air-fuel mixture is shown by arrows. The main swirling flow (thick dotted lines of FIG. 2) introduced through the feed inlet 22 moves upward while swirling and spreading along the inner circumferential surface of the combustion cylinder 4. The pressure of the region through which the main swirling flow passes is reduced, and thus the air-fuel mixture present in the central region of the combustion cylinder 4 is drawn by the main swirling flow. Eddy flows (thin dotted lines of FIG. 2) are generated in the central region. An area where the eddy flow is generated is the "area in which the air-fuel mixture is retained (retention region)." A gas flow having a lower velocity than the main swirling flow continuously flows into the retention area. In this area, the air-fuel mixture flows upward in the form of an eddy flow at an overall velocity lower than the velocity of the main swirling flow. In the retention area, where the air-fuel mixture forms an eddy flow, the air-fuel mixture is directed to the igniter 32 repeatedly. The air-fuel mixture passes by the igniter 32 repeatedly.

A typical example of the retention area is an area 39*a* located near an area 38 of the bottom cover 18 that is surrounded by the ring-shaped feed inlet 22. Likewise, an area 39*b* located near and outside the feed inlet 22 is also a retention area. As shown in FIG. 1, there is a retention area also in an area 39*c* located at the center of the combustion cylinder 4 in the vertical direction and inside the main swirling flow. These retention areas can be identified, for example, by feeding colored smoke into the combustion cylinder 4 at a velocity equal to that of the air-fuel mixture. The retention areas may be identified by simulation.

In this embodiment, the igniter 32 is located on the bottom cover 18. The igniter 32 is located inside the combustion cylinder 4. The plurality of igniters 32 are arranged on the area 38 of the bottom cover 18 that is surrounded by the ring-shaped feed inlet 22. The igniters 32 are located in the retention areas. In this embodiment, as shown in FIG. 2, the area 38 surrounded by the feed inlet 22 is circular. Although hidden by the ion detection units 12 in FIG. 2, the plurality of igniters 32 are located beneath the ion detection units 12 and arranged in a circle concentric with the area 38. The igniters 32 are arranged to form one circle concentric with the area 38 surrounded by the feed inlet 22. The igniters 32 may be arranged to form multiple circles concentric with the area 38. The igniters 32 are not limited to being arranged in a circle concentric with the area 38 surrounded by the feed inlet 22. The igniters 32 may be arranged spirally on the area 38. Only one igniter 32 may be located on the area 38.

The bottom cover 18 on which the igniters 32 are located is in an upstream region in the flow direction of the air-fuel mixture. In the combustion apparatus 2, the igniters 32 are located in the upstream region in the flow direction of the air-fuel mixture to combust the fuel sufficiently. The vertical distance between the point at which each igniter 32 ignites the air-fuel mixture (the distal end of the igniter 32) and the feed inlet 22 is preferably 50% or less, more preferably 25% or less, of the vertical length of the barrel 16.

In this embodiment, as shown in FIG. 1, the igniter 32 includes a discharge electrode 34 and a first grounded electrode 36. The discharge electrode 34 and the first grounded electrode 36 are in the shape of a bar bent in a hook-like fashion. The discharge electrode 34 and the first grounded electrode 36 project inward from the bottom cover 18. Although not shown, a grounded terminal is located on the bottom cover 18. The first grounded electrode 36 is grounded by being in contact with the terminal. The discharge electrode 34 is electrically connected to the voltage generator. A high voltage is applied to the discharge electrode 34 from the voltage generator. The voltage application produces a spark between the distal end of the discharge electrode 34 and the distal end of the first grounded electrode 36. Thus, the air-fuel mixture is ignited. The igniter 32 is an ignition plug. The igniter 32 need not be an ignition plug. The igniter 32 may be embodied by a plasma jet ignition plug.

The voltage generator generates a high voltage in response to a signal sent from the control unit 14. Although not shown, the voltage generator includes primary and secondary coils. A high voltage is intermittently generated at the secondary coil by repeatedly permitting and shutting off the current flow through the primary coil.

The ion detection units 12 detect ions present in the combustion cylinder 4. As shown in FIG. 3, each ion detection unit 12 includes a detector 40 and detection circuitry. Of these components of the ion detection units 12, the detectors 40 are shown in FIGS. 1 and 2. In this embodiment, the detectors 40 include hook-shaped detectors 40*a* and ring-shaped detectors 40*b*.

As shown in FIGS. 1 and 2, the hook-shaped detector 40*a* is located on the bottom cover 18. As shown in FIG. 2, the plurality of detectors 40*a* are arranged in a circle concentric with the area 38 surrounded by the feed inlet 22. Each hook-shaped detector 40*a* includes an application electrode 42 and a second grounded electrode 44. The application electrode 42 and the second grounded electrode 44 of the hook-shaped detector 40*a* are in the shape of a bar bent in a hook-like fashion. The application electrode 42 and the second grounded electrode 44 project inward from the bottom cover 18. In the embodiment of FIG. 1, the second grounded electrode 44 is the same electrode as the first grounded electrode 36. The second grounded electrode 44 need not be the same electrode as the first grounded electrode 36. The application electrode 42 is electrically connected to the detection circuitry.

Although not shown, the application electrode 42 may be the same electrode as the discharge electrode 34 of the igniter 32. The second grounded electrode 44 may be the same electrode as the first grounded electrode 36 while the application electrode 42 is the same electrode as the discharge electrode 34. That is, the detector 40*a* and the igniter 32 may be the same entity. Circuitry including the detection circuitry and the voltage generator integral with each other may be used. In this case, each ignition unit performs both ignition by discharge and ion detection.

The ring-shaped detectors 40*b* are located on the barrel 16. In FIG. 1, two of the ring-shaped detectors 40*b* are shown. Each ring-shaped detector 40*b* includes an application electrode 42 and a second grounded electrode 44. The application electrode 42 and the second grounded electrode 44 are in the shape of a circular ring. The application electrode 42 and the second grounded electrode 44 are attached to the inner surface of the cylindrical tube-shaped barrel 16. The application electrode 42 is electrically connected to the detection circuitry. Although not shown, a grounded terminal is located on the barrel 16. The second grounded electrode 44 is grounded by being in contact with the terminal.

Figure 4:
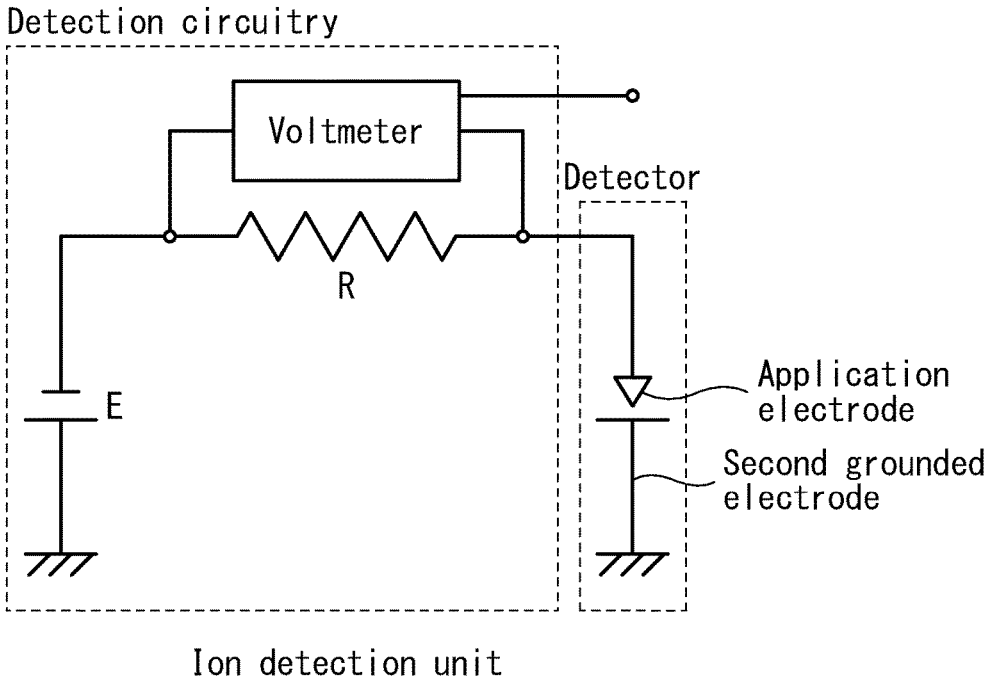
FIG. 4 is a circuit diagram showing an example of ion detection circuitry of the combustion apparatus of FIG. 1.

FIG. 4 shows an example of the circuitry of the ion detection unit 12. As shown in FIG. 4, the detection circuitry includes a power source E, a resistor R, and a voltmeter. The power source E applies a voltage to the application electrode 42 of the detector 40 through the resistor R. In this example, a negative voltage is applied to the application electrode 42. For example, the voltage of the power source E is −200 V. When ions are present around the detector 40, these ions are attracted to the application electrode 42, and a current (an ionic current) is generated. The greater the number of the ions is, the higher the generated ionic current is. The voltmeter detects and amplifies the potential difference generated between the opposite ends of the resistor R due to the ionic current. The voltmeter detects the voltage proportional to the ionic current. The ionic current is determined from the voltage. The ion detection unit 12 determines the ionic current as an ion detection result.

The power source E may apply a positive voltage to the application electrode 42. For example, the voltage of the power source E may be 200 V. When electrons generated together with ions are present around the detector 40, these electrons are attracted to the application electrode 42, and an ionic current is generated. The greater the number of the ions is, namely the greater the number of the electrons is, the higher the generated ionic current is. The ionic current is measured by measuring the voltage between the opposite ends of the resistor R.

Ions are heavier than electrons. Ions are less mobile than electrons. Upon application of a negative voltage to the application electrode 42, ions present in the vicinity of the application electrode 42 are attracted to the application electrode 42. This method is suitable for detecting the amount of ions present in the vicinity of the application electrode 42. Being more mobile than ions, electrons are attracted to the application electrode 42 from a wider area upon application of a positive voltage to the application electrode 42 than ions are attracted to the application electrode 42 upon application of a negative voltage to the application electrode 42. This method is suitable for detecting the amount of ions present over a wide area around the application electrode 42. Application of a negative voltage to the application electrode 42 or application of a positive voltage to the application electrode 42 may be selected as appropriate depending on the intended use or design concept of the combustion apparatus.

The configuration of the detection circuitry is not limited to that shown in FIG. 4. The voltmeter and resistor may be located between the power source and the application electrode 42 and connected in parallel to the power source. The detection circuitry may include, in place of the power source E of FIG. 4, a capacitor and a charging circuit that provides the capacitor with electric charge. In this configuration, a current flows between the capacitor and the application electrode 42. The detection circuitry and the voltage generator of the ignition unit 10 may be integral with each other. For example, the voltage generator may charge the capacitor of the detection circuitry at the same time as it applies a high voltage to the discharge electrode 34.

The control unit 14 is connected to the ignition units 10, the ion detection units 12, and the fuel mixing unit 8. In FIG. 1, the reference sign P denotes the lines for connection to the ignition units 10, and the reference sign I denotes the lines for connection to the ion detection units 12. As shown in FIG. 3, the control unit 14 includes an ion analyzer, a valve controller, and an ignition controller. The detection results obtained by all of the ion detection units 12 are analyzed by the ion analyzer. Based on the analysis result, the valve controller controls the valves 30. Thus, the mixing ratio of the fuel is varied. Based on the analysis result obtained by the ion analyzer, the ignition controller controls the ignition timing of each ignition unit 10. Thus, the ignition timing of each ignition unit 10 is adjusted.

The control unit 14 is typically embodied by a microcomputer. In this case, the control unit 14 does not include individual circuits that perform the functions of the ion analyzer, valve controller, and ignition controller of FIG. 3, respectively. These functions are implemented by the microcomputer and software. The control unit 14 may include circuits specialized for the ion analyzer, valve controller, and ignition controller.

At the start of combustion conducted using the apparatus 2 shown in FIGS. 1 to 4, the first and second valves 30*a* and 30*b* are opened by the control unit 14, and a gas mixture of the fuel and air is delivered to the fuel feed unit 6 at a given flow velocity. In this embodiment, an air-fuel mixture of ammonia and air is delivered to the fuel feed unit 6. The air-fuel mixture passes through the swirler 26 of the fuel feed unit 6, and the resulting swirling flow of the air-fuel mixture is delivered into the combustion cylinder 4. Each ignition unit 10 is activated by the control unit 14, and the air-fuel mixture is ignited. For this ignition, the plurality of ignition units 10 are activated simultaneously. Thus, the air-fuel mixture is combusted. Each ion detection unit 12 detects an ionic current attributed to ions generated in the combustion cylinder 4 as a result of the combustion.

A combustion method according to the present invention includes:

(1) a reference range defining step of defining a reference range for the ionic current; and (2) a combustion step of combusting the fuel continuously.

Figure 5:
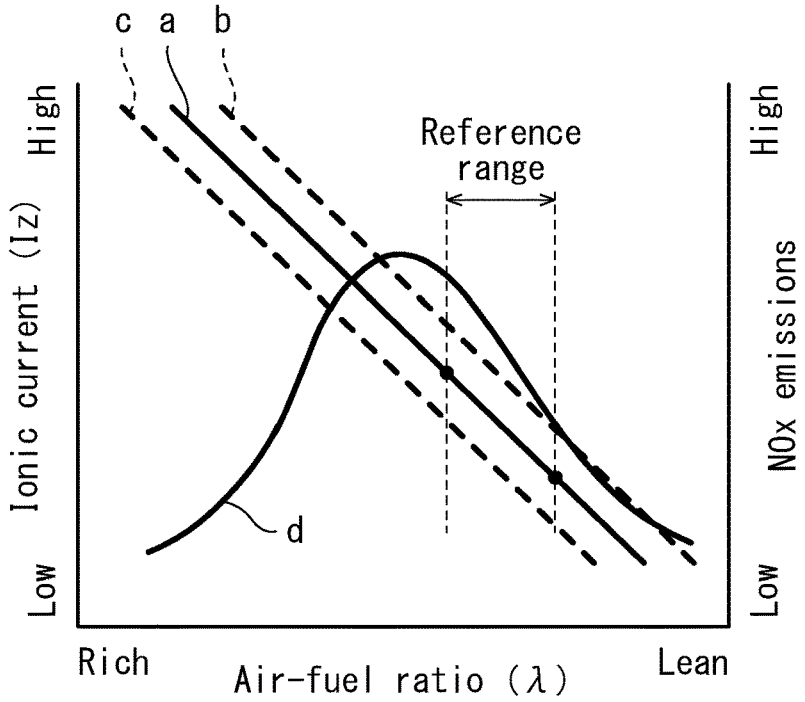
FIG. 5 is a graph representing the relationship among the mixing ratio, ionic current, and oxide emissions during fuel combustion in the combustion apparatus of FIG. 1.

In the step (1), the correlation between the ionic current and a parameter indicative of the combustion state is measured. In FIG. 5, the straight line a represents the relationship between the mixing ratio of the fuel (ammonia) and air (air-fuel ratio λ) and the ionic current Iz (this relationship will be referred to as "λ-Iz function") in the case where the air-fuel mixture flows at a given flow velocity. FIG. 5 shows that the lower the air-fuel ratio λ is, the higher the ionic current Iz is. In FIG. 5, the curve d represents the relationship between the air-fuel ratio λ and the amount of oxides (nitrogen oxides $NO_x$) emitted during combustion of the fuel. The amount of nitrogen oxides reaches a peak at a given value of the air-fuel ratio λ. The amount of nitrogen oxides decreases as the air-fuel ratio λ increases or decreases from the given value of the air-fuel ratio λ. In the step (1), data representing the λ-Iz function is obtained as map data. Such map data are obtained for different temperatures and pressures inside the combustion cylinder. The reference range for the ionic current is defined taking into account the maintenance of stable combustion, the fuel economy, and the oxide emissions. FIG. 5 shows an example of the reference range. The map data and reference range are stored in non-illustrated memory circuitry of the control unit 14.

In the step (2), the air-fuel mixture is continuously delivered into the combustion cylinder 4, and the ignition units 10 are activated at regular time intervals. Thus, the air-fuel mixture is continuously combusted. During the continuous combustion, the ion detection units 12 detect ionic currents attributed to ions present in the combustion cylinder 4. The control unit 14 determines the air-fuel ratio λ based on the detected ionic currents and the λ-Iz function described above. The control unit 14 regulates the first and second valves 30*a* and 30*b* to allow the ionic currents to fall within the reference range defined in the step (1). The air-fuel ratio λ is adjusted to allow the ionic currents to fall within the reference range defined in the step (1).

In the above embodiment, the λ-Iz function at a given flow velocity of the air-fuel mixture (i.e., the straight line a) is used to determine the air-fuel ratio λ. In fact, the flow velocity of the air-fuel mixture is variable. In another embodiment of the combustion method, a correction process taking into account the flow velocity variation may be carried out to determine the air-fuel ratio λ more accurately. This method will be described hereinafter.

Figure 6:
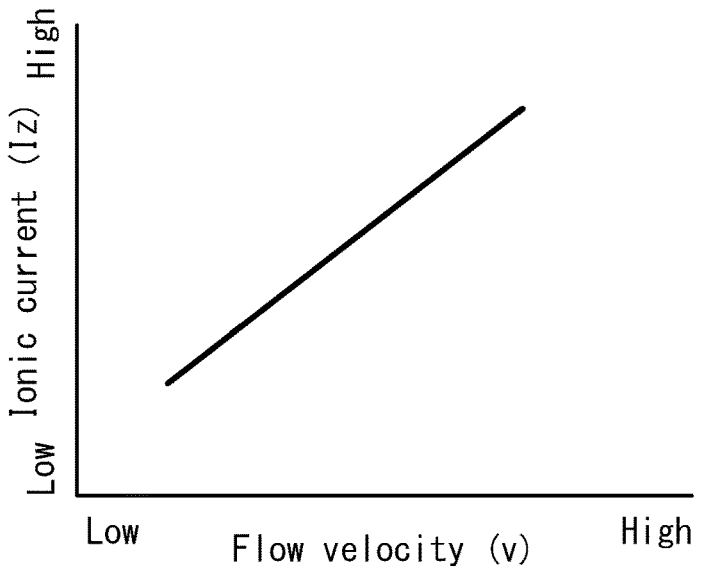
FIG. 6 is a graph representing the relationship between the fuel flow rate and the ionic current during fuel combustion in the combustion apparatus of FIG. 1.

FIG. 6 shows the relationship between the flow velocity v and the ionic current Iz at a reference value of the air-fuel ratio λ (this relationship will be referred to as "v-Iz function"). As shown in FIG. 6, the ionic current Iz becomes higher with increasing flow velocity v. In this embodiment, the v-Iz function is obtained as map data in the step (1). Such map data are obtained for different values of the air-fuel ratio λ although only the v-Iz function at the reference value of the air-fuel ratio λ is shown in FIG. 6. These map data are stored in the memory circuitry of the control unit 14.

In FIG. 5, the dashed line b represents the λ-Iz function in a high velocity state where the flow velocity is high. The dashed line c represents the λ-Iz function in a low velocity state where the flow velocity is low. In the step (1), these data are obtained as map data. These map data are stored in the memory circuitry of the control unit 14. Although the λ-Iz functions at three flow velocity values are shown in FIG. 5, the λ-Iz functions may be obtained at four or more flow velocity values.

In this embodiment, when determining the air-fuel ratio λ during the step (2), the control unit 14 determines the flow velocity v based on the detection results of the ion detection units 12 and using the map data of the v-Iz function. In this process, the map data at the air-fuel ratio λ determined in the previous process is used. Thus, for example, the control unit 14 determines that the combustion state is a high velocity state. In this case, the control unit 14 determines the air-fuel ratio λ using the λ-Iz function shown in FIG. 5 for the high velocity state. The map data obtained at this air-fuel ratio λ is used the next time the map data of FIG. 6 is used. The flow velocity v is determined using the map data. This process is repeated.

The following describes advantageous effects of the present invention.

In the fuel combustion apparatus 2 according to the present invention, a swirling flow of the air-fuel mixture containing the fuel is introduced into the combustion cylinder 4. The swirling flow of the air-fuel mixture includes an eddy flow moving at an overall velocity lower than the velocity of the main swirling flow. The combustion apparatus 2 can combust a flame-retardant fuel having a low laminar burning velocity.

The igniters 32 of the ignition units 10 of the combustion apparatus 2 are located in areas which are inside the combustion cylinder 4 and in which the air-fuel mixture is retained. The air-fuel mixture in the form of an eddy flow having a lower velocity than the main swirling flow continuously flows into the retention areas. Thus, the air-fuel mixture is directed to the igniters 32 repeatedly. The air-fuel mixture passes by the igniters 32 repeatedly. Thus, the igniters 32 can impart high energy to the air-fuel mixture. The apparatus 2 can impart sufficient energy for ignition to the fuel even when the ignition energy of the fuel is high.

The combustion apparatus 2 includes the detectors 40 of the ion detection units 12 in the combustion cylinder 4. Since the detectors 40 detect ions generated by combustion, the combustion state of the air-fuel mixture can be identified. The combustion apparatus 2 includes the control unit 14 that adjusts the mixing ratio of the fuel based on the detection results and thus can achieve appropriate air-fuel ratio control based on the identified combustion state. This contributes to the maintenance of stable combustion. The combustion apparatus 2 can stably maintain combustion of a flame-retardant fuel.

One or more of the detectors 40 are preferably located in the vicinity of the igniters 32 as shown in FIG. 1. The igniters 32 are located in the retention areas. The ionic currents detected by the detectors 40 located in the vicinity of the igniters 32 reflect the combustion state in the areas where effective energy supply is ensured. This makes it possible to identify the state of the flame kernel. The apparatus 2 can achieve the control of the air-fuel ratio and the control of the ignition timing of the ignition units 60 based on the state of the flame kernel. The combustion apparatus 2 can combust a flame-retardant fuel stably and efficiently.

The mixing ratio of the fuel influences the amount of generated oxides. The adjustment of the mixing ratio of the fuel can contribute to reduction in the oxide generation. The combustion apparatus 2 can maintain stable combustion of a flame-retardant fuel and at the same time reduce the oxide emissions.

The combustion method using the apparatus 2 includes the step of measuring the correlation between a parameter indicative of the combustion state of the fuel and the ionic current and defining a reference range for the ionic current. In the step of combusting the fuel continuously, the ionic current levels detected by the ion detection units 12 are controlled to be within the reference range, and thus an appropriate combustion state can be maintained.

The parameter indicative of the combustion state preferably includes the amount of emitted oxides. In this case, combustion can be achieved in which the oxide emissions are more effectively reduced. The combustion method can ensure stable combustion of a flame-retardant fuel and at the same time reduce the oxide emissions.

In the case where each igniter 32 includes the discharge electrode 34 and the first grounded electrode 36 and each detector 40 includes the application electrode 42 and the second grounded electrode 44, the first grounded electrode 36 and the second grounded electrode 44 are preferably the same electrode. This reduces the extent to which the grounded electrodes impede efficient combustion.

One or more of the detectors 40 are preferably located on the inner surface of the barrel 16 and aligned in a direction away from the bottom cover 18 as shown in FIG. 1. In this case, the combustion state of the fuel at locations above the feed inlet 22 can be detected. This contributes to appropriate determination of the mixing ratio of the fuel and the ignition timing of the ignition units 10. The combustion apparatus 2 can combust a flame-retardant fuel stably and efficiently and at the same time reduce the oxide emissions.

As previously stated, the igniters 32 are preferably arranged on the area 38 of the bottom cover 18 that is surrounded by the ring-shaped feed inlet 22. The flow of the air-fuel mixture is retained inside the ring-shaped feed inlet 22. In the case where the igniters 32 of the ignition units 10 are arranged on the area 38, the air-fuel mixture in the form of an eddy flow is directed to the igniters 32 repeatedly. The air-fuel mixture passes by the igniters 32 repeatedly. Thus, the apparatus 2 can impart sufficient energy for ignition to the fuel even when the fuel is flame-retardant. Additionally, the igniters 32 are located in an upstream region in the flow direction of the air-fuel mixture. For these reasons, even a flame-retardant fuel can be ignited and combusted stably.

As previously stated, in the case where the area 38 surround by the feed inlet 22 is circular, the igniters 32 are preferably arranged in a circle concentric with the area 38. In this case, the air-fuel mixture can be ignited uniformly around the feed inlet 22. This allows for stable ignition of the air-fuel mixture.

Although not shown, the combustion apparatus 2 may include a temperature sensor that measures the temperature inside the combustion cylinder 4. The temperature sensor is connected to the control unit 14, and the temperature measurement result is sent to the control unit 14. In general, the higher the temperature inside the combustion cylinder 4 is, the more easily the fuel is burned. At a higher temperature, ammonia is more combustible, so that the amount of emitted nitrogen oxides ($NO_x$) is reduced. In the combustion apparatus 2, the control unit 14 adjusts the mixing ratio of the fuel based on the temperature measurement result. The control unit 14 controls the ignition timing of the ignition units 10 based on the temperature measurement result. These features contribute to the maintenance of stable combustion. The combustion apparatus 2 can maintain stable combustion.

Although not shown, the combustion apparatus 2 may include a pressure sensor that measures the pressure inside the combustion cylinder 4. The pressure sensor is connected to the control unit 14, and the pressure measurement result is sent to the control unit 14. In general, the higher the pressure inside the combustion cylinder 4 is, the more easily the fuel is burned. At a higher pressure, ammonia is more combustible, so that the amount of emitted nitrogen oxides ($NO_x$) is reduced. In the combustion apparatus 2, the control unit 14 adjusts the mixing ratio of the fuel based on the pressure measurement result. The control unit 14 controls the ignition timing of the ignition units 10 based on the pressure measurement result. These features contribute to the maintenance of stable combustion. The combustion apparatus 2 can maintain stable combustion.

Although not shown, the combustion apparatus 2 may include a drive mechanism that controls the angle of the vanes of the swirler 26. The drive mechanism is connected to the control unit 14. The control unit 14 controls the vane angle through the drive mechanism, thus adjusting the swirl ratio of the swirling flow. The control unit 14 adjusts the vane angle based on the measurement results of the ionic current, temperature, and pressure which are described above. These features contribute to the maintenance of stable combustion. The combustion apparatus 2 can maintain stable combustion.

Figure 7:
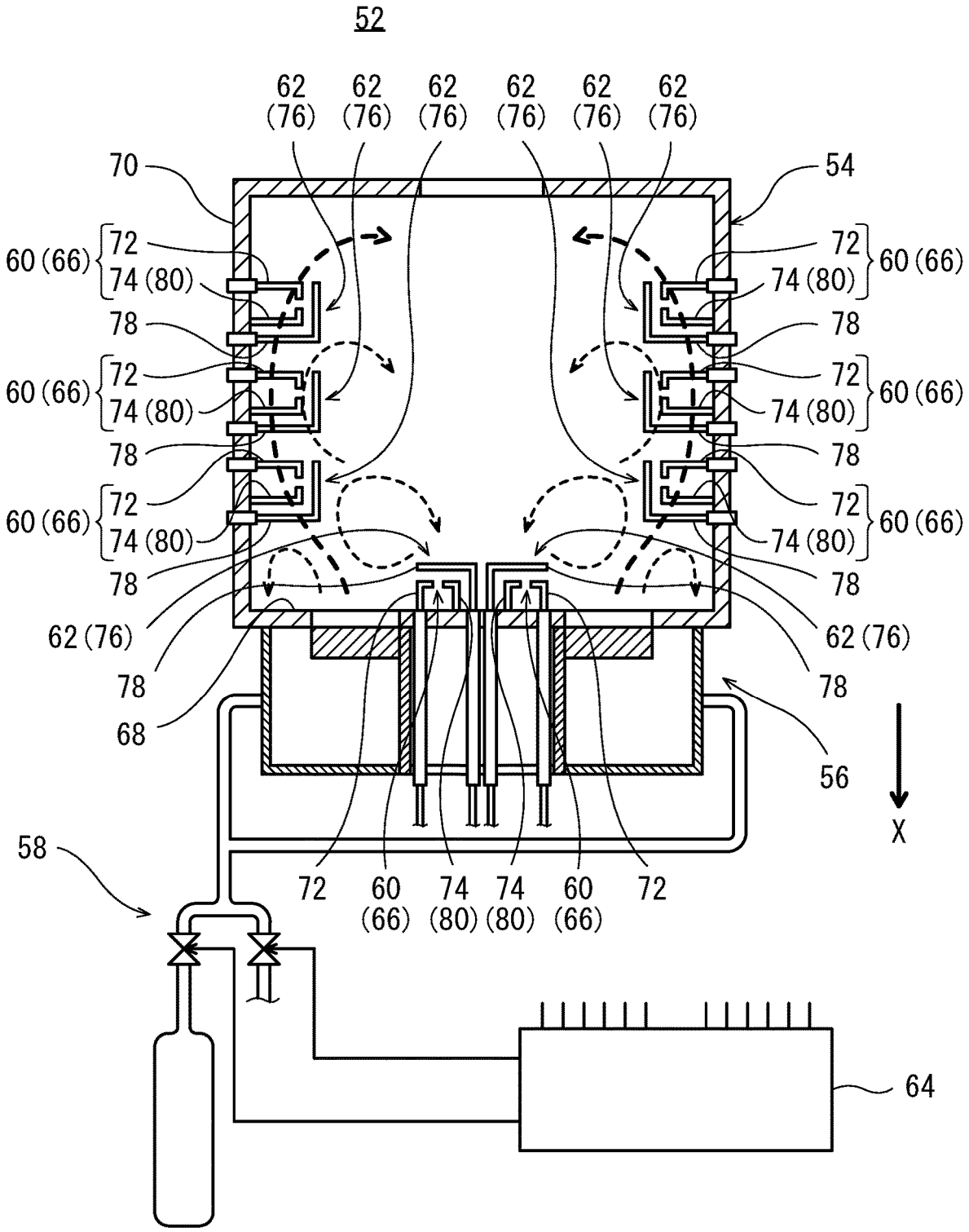
FIG. 7 is a conceptual diagram of a combustion apparatus according to another embodiment of the present invention.

FIG. 7 is a conceptual diagram of a fuel combustion apparatus 52 according to another embodiment of the present invention. In this figure, part of the apparatus 52 is shown in cross-section. The combustion apparatus 52 includes a combustion cylinder 54, a fuel feed unit 56, a fuel mixing unit 58, ignition units 60, ion detection units 62, and a control unit 64. In this embodiment, the material of the combustion cylinder 54 is steel. The fuel feed unit 56, fuel mixing unit 58, and control unit 64 of the combustion apparatus 52 are the same as the corresponding units of the combustion apparatus 2 of FIG. 1. The direction indicated by the arrow X of FIG. 7 is the downward direction with respect to the combustion apparatus 52, and the opposite direction is the upward direction with respect to the combustion apparatus 52.

Each ignition unit 60 includes an igniter 66 and a voltage generator. Of these components of the ignition units 60, the igniters 66 are shown in FIG. 7. In this embodiment, as shown in FIG. 7, each igniter 66 is located on the bottom cover 68 or the barrel 70. Some of the igniters 66 are located on the bottom cover 68, and the other igniters 66 are located on the barrel 70. The igniters 66 on the bottom cover 68 are located in the retention areas as is the case with the igniters 32 of FIG. 1. Some of the igniters 66 on the barrel 70 are located in areas in which the air-fuel mixture is not retained. For example, some of the igniters 66 are located in areas through which the main swirling flow passes. In this embodiment, some of the igniters 66 are located in the retention areas, and the other igniters 66 are located in areas away from the retention areas. Although not shown, the voltage generator in this embodiment is the same as the voltage generator of FIG. 3.

Each of the igniters 66 located on the bottom cover 68 includes a discharge electrode 72 and a first grounded electrode 74. The first grounded electrode 74 is grounded by being in contact with the bottom cover 68 which is grounded. The discharge electrode 72 has the same structure as the discharge electrode 34 of FIG. 1.

The igniters 66 located on the barrel 70 are aligned in a direction away from the bottom cover 68. Each of the igniters 66 includes a discharge electrode 72 and a first grounded electrode 74. The discharge electrode 72 and the first grounded electrode 74 are in the shape of a bar bent in a hook-like fashion. The discharge electrode 72 and the first grounded electrode 74 of each of the igniters 66 located on the barrel 70 project inward from the inner surface of the barrel 70. The first grounded electrode 74 is grounded by being in contact with the barrel 70 which is grounded. The discharge electrode 72 is electrically connected to the voltage generator. A high voltage is applied to the discharge electrode 72 from the voltage generator. The voltage application produces a spark between the distal end of the discharge electrode 72 and the distal end of the first grounded electrode 74. Thus, the air-fuel mixture is ignited.

Each ion detection unit 62 includes a detector 76 and detection circuitry. Of these components of the ion detection units 62, the detectors 76 are shown in FIG. 7. As shown in FIG. 7, each detector 76 is located on the bottom cover 68 or the barrel 70. Some of the detectors 76 are located on the bottom cover 68, and the other detectors 76 are located on the barrel 70. In this embodiment, all of the detectors 76 are hook-shaped. The detectors 76 located on the bottom cover 68 have the same structure as the detectors 40 of FIG. 1. Although not shown, the detection circuitry in this embodiment is the same as the detection circuitry of FIG. 4.

The detectors 76 located on the barrel 70 are aligned in a direction away from the bottom cover 68. Each detector 76 includes an application electrode 78 and a second grounded electrode 80. The application electrode 78 and the second grounded electrode 80 are in the shape of a bar bent in a hook-like fashion. The application electrode 78 and the second grounded electrode 80 of each of the detectors 76 located on the barrel 70 project inward from the inner surface of the barrel 70. Each of the detectors 76 is in the vicinity of a corresponding one of the igniters 66 located on the barrel 70. In the embodiment of FIG. 7, the second grounded electrode 80 is the same electrode as the first grounded electrode 74 of the igniter 66 located on the barrel 70. The second grounded electrode 80 need not be the same electrode as the first grounded electrode 74. The application electrode 78 is electrically connected to the detection circuitry.

In the combustion apparatus 52, the igniters 66 of the ignition units 60 are located not only on the bottom cover 68 but also on the barrel 70. The igniters 66 located on the barrel 70 are aligned in a direction away from the bottom cover 68. In the combustion apparatus 52, the fuel can be ignited also in the central and upper regions of the barrel 70. In this combustion apparatus 52, the fuel can be combusted in a balanced way over the entire combustion cylinder 54. Thus, even a flame-retardant fuel can be ignited and combusted stably.

In the combustion apparatus 52, the detectors 76 of the ion detection units 62 are located in the vicinity of the igniters 66 on the bottom cover 68 and in the vicinity of the igniters 66 on the barrel 70. That is, the detectors 76 are located in the vicinity of the igniters 66 located in the retention areas and in the vicinity of the igniters 66 located in areas away from the retention areas. The ionic currents detected by the detectors 76 in the vicinity of the igniters 66 located in the retention areas reflect the combustion state in the areas where effective energy supply is ensured. This makes it possible to identify the state of the flame kernel. The apparatus 52 can achieve the control of the air-fuel ratio and the control of the ignition timing of the ignition units 60 based on the state of the flame kernel. This contributes to the formation of a stale flame kernel. The combustion apparatus 52 can maintain stable combustion.

The ionic currents detected by the detectors 76 in the vicinity of the igniters 66 located in areas away from the retention areas reflect the combustion state in the areas in which the fuel flows at a relatively high velocity. This makes it possible to identify the level of stability of the combustion. The apparatus 52 can achieve the control of the air-fuel ratio and the control of the ignition timing of the ignition units 60 based on the level of stability of the combustion. This contributes to stabilization of the combustion.

Although not shown, the combustion apparatus 52 may include a plurality of temperature sensors located in the combustion cylinder 54 and aligned in a direction away from the bottom cover. These temperature sensors measure the temperature distribution in the combustion cylinder 54. In the combustion apparatus 52, the control unit 64 controls the ignition timing of each ignition unit 60 based on the temperature measurement results. Each ignition unit 60 can be activated at an appropriate time depending on the location of the igniter 66. These features contribute to the maintenance of stable combustion. The combustion apparatus 52 can maintain stable combustion.

Although not shown, the combustion apparatus 52 may include a plurality of pressure sensors located in the combustion cylinder 54 and aligned in a direction away from the bottom cover. These pressure sensors measure the pressure distribution in the combustion cylinder 54. In the combustion apparatus 52, the control unit 64 controls the ignition timing of each ignition unit 60 based on the pressure measurement results. Each ignition unit 60 can be activated at an appropriate time depending on the location of the igniter 66. These features contribute to the maintenance of stable combustion. The combustion apparatus 52 can maintain stable combustion.

Figure 8:
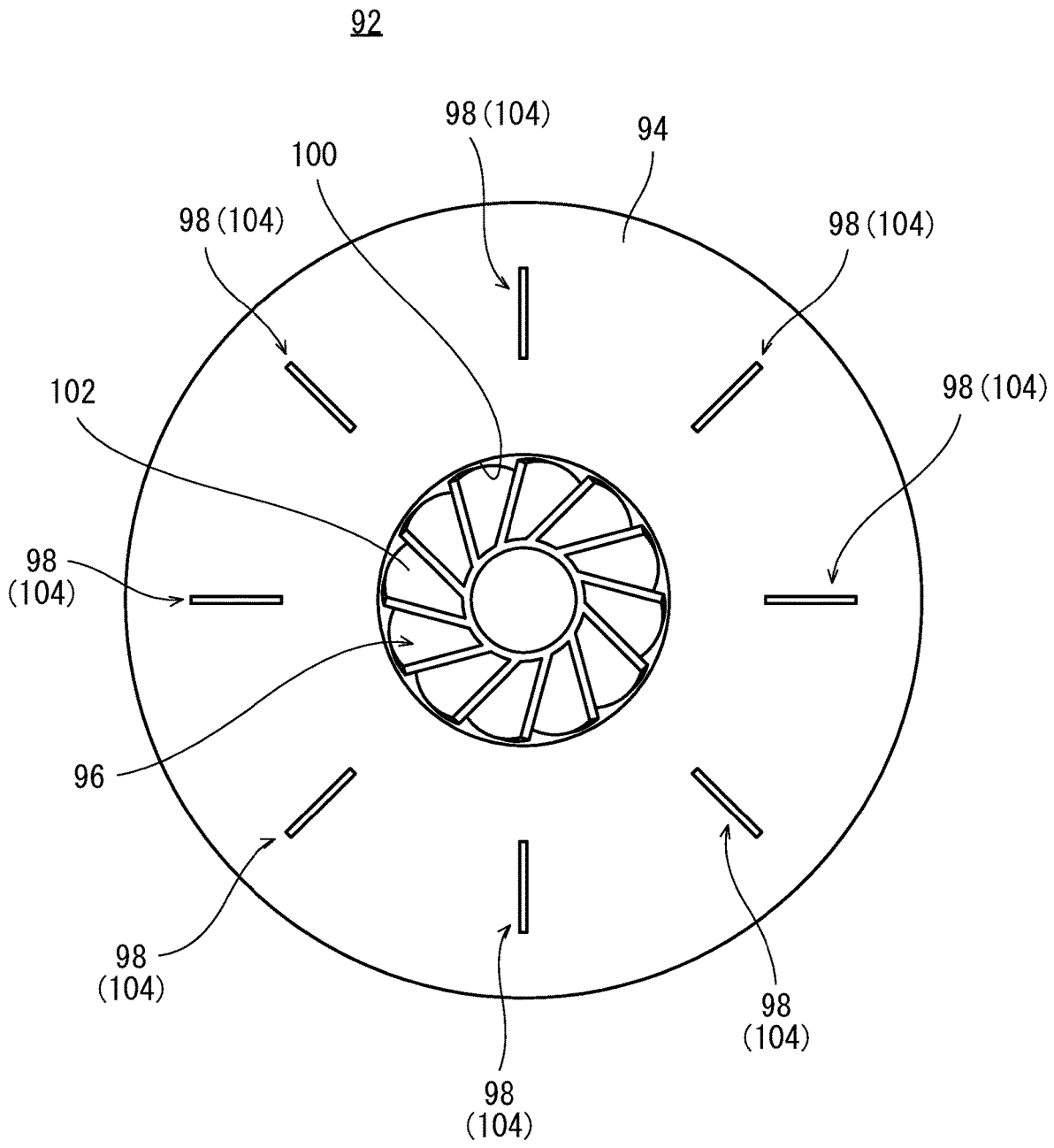
FIG. 8 is a top view of part of a combustion apparatus according to yet another embodiment of the present invention.

FIG. 8 is a top view of a bottom cover 94 of a fuel combustion apparatus 92 according to yet another embodiment of the present invention. The combustion apparatus 92 is identical to the combustion apparatus 2 of FIGS. 1 and 2, except for the bottom cover 94, a fuel feed unit 96, ignition units, and ion detection units 98.

As shown in FIG. 8, the bottom cover 94 of the combustion apparatus 92 includes a feed inlet 100. An air-fuel mixture containing a fuel is introduced through the feed inlet 100. In this embodiment, the feed inlet 100 is circular.

The fuel feed unit 96 is located beneath the bottom cover 94 of the combustion cylinder. The fuel feed unit 96 includes a swirler 102. In FIG. 8, the swirler 102 located beneath the feed inlet 100 is seen through the feed inlet 100. The air-fuel mixture passes through the swirler 102, thus forming a swirling flow. The swirling flow of the air-fuel mixture is introduced into the combustion cylinder. The material of the swirler 102 is typically steel.

Although hidden by detectors 104 in FIG. 8, a plurality of igniters are located beneath the detectors 104. The igniters are arranged on the bottom cover 94 in such a manner as to encircle the circular feed inlet 100. The region around the feed inlet 100 is a retention area. The air-fuel mixture in the form of an eddy flow having a lower velocity than the main swirling flow continuously flows into the retention area. Thus, the air-fuel mixture is directed to the igniters repeatedly. The air-fuel mixture passes by the igniters repeatedly. Thus, the igniters can impart high energy to the air-fuel mixture. The apparatus 92 can impart sufficient energy for ignition to the fuel even when the ignition energy of the fuel is high.

In this embodiment, the igniters are arranged in a circle concentric with the circular feed inlet 100. The igniters are arranged to form one circle concentric with the feed inlet 100. Thus, the air-fuel mixture can be ignited uniformly around the feed inlet 100. As such, the air-fuel mixture can be ignited stably.

Although not shown, the igniters may be arranged to form multiple circles concentric with the feed inlet 100. The igniters may be arranged spirally in such a manner as to encircle the feed inlet 100. Thus, the air-fuel mixture can be ignited uniformly around the feed inlet 100. This allows for stable ignition of the air-fuel mixture.

The detectors 104 of the ion detection units 98 are located on the bottom cover 94. The detectors 104 are hook-shaped. As shown in FIG. 8, the detectors 104 are arranged in a circle concentric with the circular feed inlet 100. The detectors 104 are located in the vicinity of the igniters. The ionic currents detected by the detectors 104 reflect the combustion state in the areas where effective energy supply is ensured. This makes it possible to identify the state of the flame kernel. The apparatus 92 can achieve the control of the air-fuel ratio and the control of the ignition timing of the ignition units based on the state of the flame kernel.

In the combustion apparatuses of the above embodiments, the fuel is introduced continuously. The combustion apparatuses can be used in internal combustion engines such as those of automobiles. In the case where any of the combustion apparatuses is used in an internal combustion engine, a cycle consisting of introducing the fuel into the combustion cylinder and igniting the fuel is repeated.

As described above, the present invention can provide a combustion apparatus capable of stably maintaining combustion of flame-retardant fuels. This demonstrates the superiority of the present invention.

INDUSTRIAL APPLICABILITY

The fuel combustion apparatuses described above can be used in various types of equipment.

REFERENCE SIGNS LIST

2, 52, 92 . . . combustion apparatus
4, 54 . . . combustion cylinder
6, 56 . . . fuel feed unit
8, 58 . . . fuel mixing unit
10, 60 . . . ignition unit
12, 62, 98 . . . ion detection unit
14, 64 . . . control unit
16, 70 . . . barrel
18, 68, 94 . . . bottom cover
20 . . . bottom
22, 100 . . . feed inlet
24 . . . housing
26, 102 . . . swirler
28 . . . fuel tank
30 . . . valve
30*a* . . . first valve
30*b* . . . second valve
32, 66 . . . igniter
34, 72 . . . discharge electrode
36, 74 . . . first grounded electrode
38 . . . area surrounded by feed inlet

40, 76 . . . detector
40*a* . . . hook-shaped detector
40*b* . . . ring-shaped detector
42, 78, 104 . . . application electrode
44, 80 . . . second grounded electrode

The invention claimed is:

1. A combustion apparatus that combusts a fuel, the combustion apparatus comprising:
a combustion cylinder;
a fuel feed unit that introduces a swirling flow of an air-fuel mixture into the combustion cylinder;
an ignition unit including an igniter located in the combustion cylinder;
a plurality of ion detection units each of which includes a detector located in the combustion cylinder; and
a control unit that adjusts a mixing ratio of the air-fuel mixture based on a detection result obtained by the ion detection unit,
wherein the combustion cylinder includes a tubular barrel and a bottom cover is mounted on a bottom of the tubular barrel, and
at least first one detector extends from the bottom cover toward an interior of the combustion cylinder, and at least second one detector extends from the tubular barrel toward the interior of the combustion cylinder.

2. The combustion apparatus according to claim 1, wherein the fuel is ammonia.

3. The combustion apparatus according to claim 1, wherein at least one of said at least first one detector and said at least second one detector is located in the vicinity of the igniter.

4. The combustion apparatus according to claim 1, wherein at least one of said at least first one detector and said at least second one detector is the same entity as the igniter.

5. The combustion apparatus according to claim 1, wherein
the igniter includes a discharge electrode and a first grounded electrode,
at least one of said at least first one detector and said at least second one detector includes an application electrode and a second grounded electrode, and
the first and second grounded electrodes are the same electrode.

6. The combustion apparatus according to claim 1, wherein the igniter is located in an area which is inside the combustion cylinder and in which the air-fuel mixture is retained.

7. The combustion apparatus according to claim 6, wherein
the combustion cylinder includes a tubular barrel and a bottom cover mounted on a bottom of the barrel,
the bottom cover includes a feed inlet through which the air-fuel mixture is introduced into the barrel, and
the igniter and at least one of said at least first one detector and said at least second one detector are located on the bottom cover.

8. The combustion apparatus according to claim 7, wherein the detectors are located on each of the bottom cover and the barrel.

9. The combustion apparatus according to claim 7, wherein
the feed inlet is ring-shaped, and
the igniter and said at least first one detector are located on an area of the bottom cover, the area being surrounded by the feed inlet.

10. The combustion apparatus according to claim 7, wherein
the feed inlet is circular, and
the igniter and said at least first one detector on the bottom cover are arranged around the feed inlet.

11. The combustion apparatus according to claim 1, wherein
the igniter is located in an area which is inside the combustion cylinder and in which the air-fuel mixture is not retained, or
the igniter is one of a plurality of igniters located in the combustion cylinder, and at least one of the igniters is located in the area in which the air-fuel mixture is not retained.

12. The combustion apparatus according to claim 11, wherein the igniters are located on the bottom cover and the barrel.

13. A fuel combustion method comprising:
a combustion step of combusting a fuel continuously, wherein
the combustion step includes:
introducing a swirling flow of an air-fuel mixture into a combustion cylinder;
igniting the introduced air-fuel mixture;
detecting ions generated by the combustion of the fuel; and
adjusting a mixing ratio of the air-fuel mixture based on an ion detection result,
wherein the fuel combustion method further comprises the step of measuring a correlation between a parameter indicative of a combustion state of the air-fuel mixture and the ion detection result and defining a reference range for the ion detection result before the combustion step, and
wherein a mixing ratio of the air-fuel mixture is adjusted to allow the ion detection result to fall within the reference range.

14. The fuel combustion method according to claim 13, wherein the parameter indicative of the combustion state of the air-fuel mixture includes the amount of oxides emitted during the combustion.

15. The combustion apparatus according to claim 1, wherein
the combustion cylinder further includes a top cover mounted on a top of the barrel
the bottom cover includes a feed inlet through which the air-fuel mixture is introduced into the barrel, and
the top cover includes an outlet from which a flame spurts.

16. The combustion apparatus according to claim 1, further comprising a plurality of ignition units each of which includes an igniter located in the combustion cylinder,
wherein at least one first igniter extends from the bottom cover toward the interior of the combustion cylinder, and at least one second igniter extends from the tubular barrel toward the interior of the combustion cylinder.

17. The combustion apparatus according to claim 1, wherein
the bottom cover includes a ring-shaped feed inlet through which the air-fuel mixture is introduced into the barrel, and
said at least first one igniter and said at least first one detector are located on an area of the bottom cover, the area being surrounded by the feed inlet.

18. The combustion apparatus according to claim 1, wherein the bottom cover including a feed inlet, a fuel feed unit including a swirler placed beneath the feed inlet and configured to introduce a swirling flow of an air-fuel mixture into the combustion cylinder through the feed inlet, wherein the ignition unit is arranged beneath one of the ion detection units and between the ion detection unit and the bottom cover, and wherein the feed inlet is arranged radially outward of the ignition unit and at least one ion detection unit.

* * * * *